US005188556A

United States Patent [19]

Hartelius et al.

[11] Patent Number: 5,188,556

[45] Date of Patent: Feb. 23, 1993

[54] BALL ROLLING TOY

[75] Inventors: Mark Hartelius, 18084 S. Shore La. West, Eden Prairie, Minn. 55348; Randy Randleman, White Bear Lake, Minn.

[73] Assignee: Mark Hartelius, Eden Prairie, Minn.

[21] Appl. No.: 806,491

[22] Filed: Dec. 13, 1991

[51] Int. Cl.[5] ..... A63H 29/08; A63H 29/00

[52] U.S. Cl. ..... 446/172; 446/430; 124/78; 273/129 P

[58] Field of Search ..... 446/168, 169, 170, 171, 446/172, 173, 174, 404, 409, 411, 412, 413, 450, 451, 429, 430, 144, 237; 124/10, 78, 79, 81; 273/129 P, 129 V, 129 W

[56] References Cited

U.S. PATENT DOCUMENTS

| | | | |
|---|---|---|---|
| 591,234 | 10/1897 | Loring | 273/112 |
| 1,736,176 | 11/1929 | Shephard | 446/172 |
| 2,083,119 | 6/1937 | Hense | 273/119 R |
| 2,566,379 | 9/1951 | Strong | 124/78 X |
| 3,048,402 | 8/1962 | Schaper | 273/119 |
| 3,208,185 | 9/1965 | Silvera | 446/137 |
| 3,641,704 | 2/1972 | Sims et al. | 446/429 |
| 3,959,922 | 6/1976 | Leistikow | 446/144 |
| 3,992,006 | 11/1976 | Barlow | 273/85 D X |
| 4,061,334 | 12/1977 | Kanno | 273/119 |
| 4,143,482 | 3/1979 | Meyer et al. | 446/172 |
| 4,191,374 | 3/1980 | Kulesza et al. | 124/78 X |
| 4,248,009 | 2/1981 | Ferris et al. | 446/409 |
| 4,287,680 | 9/1981 | Allen et al. | 446/172 X |
| 4,292,756 | 10/1981 | Jaworski et al. | 446/246 |
| 4,361,980 | 12/1982 | Chatani | 446/409 |
| 4,552,120 | 11/1985 | Nall et al. | 124/78 X |
| 4,604,074 | 8/1986 | Engle et al. | 446/171 |
| 4,822,049 | 4/1989 | Biber | 273/110 |
| 4,863,169 | 9/1989 | Miyazaki | 446/168 X |
| 4,875,459 | 10/1989 | Van Elderen et al. | 124/78 X |

OTHER PUBLICATIONS

Mattel ® Tumblin Beads ® push toy.

*Primary Examiner*—D. Neal Muir

*Attorney, Agent, or Firm*—Peterson, Wicks, Nemer & Kamrath

[57] ABSTRACT

A toy (10) is disclosed including a spinner (34) having an annular member (38) formed of compressible material rotatably moveable relative to first and second, semiconductor walls (18, 28). A first track wall defined by walls (14, 16, 20) extends between the extremities of the first wall (18). A second track wall defined by walls (24, 26, 30) extends between the extremities of the second wall (28) parallel to and spaced from the first track wall, with the first and second track walls defining a track for rolling receipt of the balls (76). The track includes first and second inclined portions having a bell (68) at their interconnection. In operation, balls (76) compress the compressible material and are captured between the annular member (38) and the first wall (18) when the spinner (34) is rotated. The captured balls (76) are moved relative to the first wall (18) with the rotation of the spinner (34) until they reach the first extremity of the first wall (18) and are released into the track with a spring force due to the expansion of the annular member (38) from its compressed condition. The balls (76) fall down the first inclined portion, hit and ring the bell (68) as they pivot and change their direction to and down the second inclined portion back towards the spinner (34).

16 Claims, 1 Drawing Sheet

BALL ROLLING TOY

BACKGROUND

The present invention relates to toys, and particularly to toys providing stimulation particularly for very small children.

A great variety of toys exist for children of all ages, and the sale of toys is a highly competitive business. The play as well as the educational values are important in the marketability of any particular toy. The play and educational values of the toy are often directly related to the stimulation it provides to the child. Particularly for very small children who are in the early stages of development, visual stimulation resulting from movable components as well as auditory stimulation such as bell sounds provide the motivation to the child to manually manipulate components of the toy to increase their manipulative abilities.

Consequently, new toys are constantly being developed to replace existing toys as those existing toys lose their novelty and appeal.

SUMMARY

Accordingly, it is an object of the present invention to provide a novel toy.

It is further an object of the present invention to provide such a novel toy which is inexpensive to manufacture and assemble.

It is further an object of the present invention to provide such a novel toy including a relatively small number of components while still providing relative movement therebetween.

It is further an object of the present invention to provide such a novel toy providing visual and auditory stimulation.

It is further an object of the present invention to provide such a novel toy requiring manual manipulation.

The above and other aims and objects can be satisfied in the field of toys by providing, in the preferred form, a device for moving compressible material relative to a wall for capturing balls located at the second end of the track between the compressible material and the wall for moving the ball between the extremities of the wall as the compressible material moves to the first end of the track.

In the most preferred form of the present invention, the wall has a semicircular shape and the compressible material has a cylindrical shape, with the compressible material being rotated concentrically to the wall.

The present invention will become clearer in light of the following detailed description of an illustrative embodiment of the present invention described in connection with the drawings.

DESCRIPTION OF THE DRAWINGS

The illustrative embodiment may best be described by reference to the accompanying drawings where.

Figure 1:
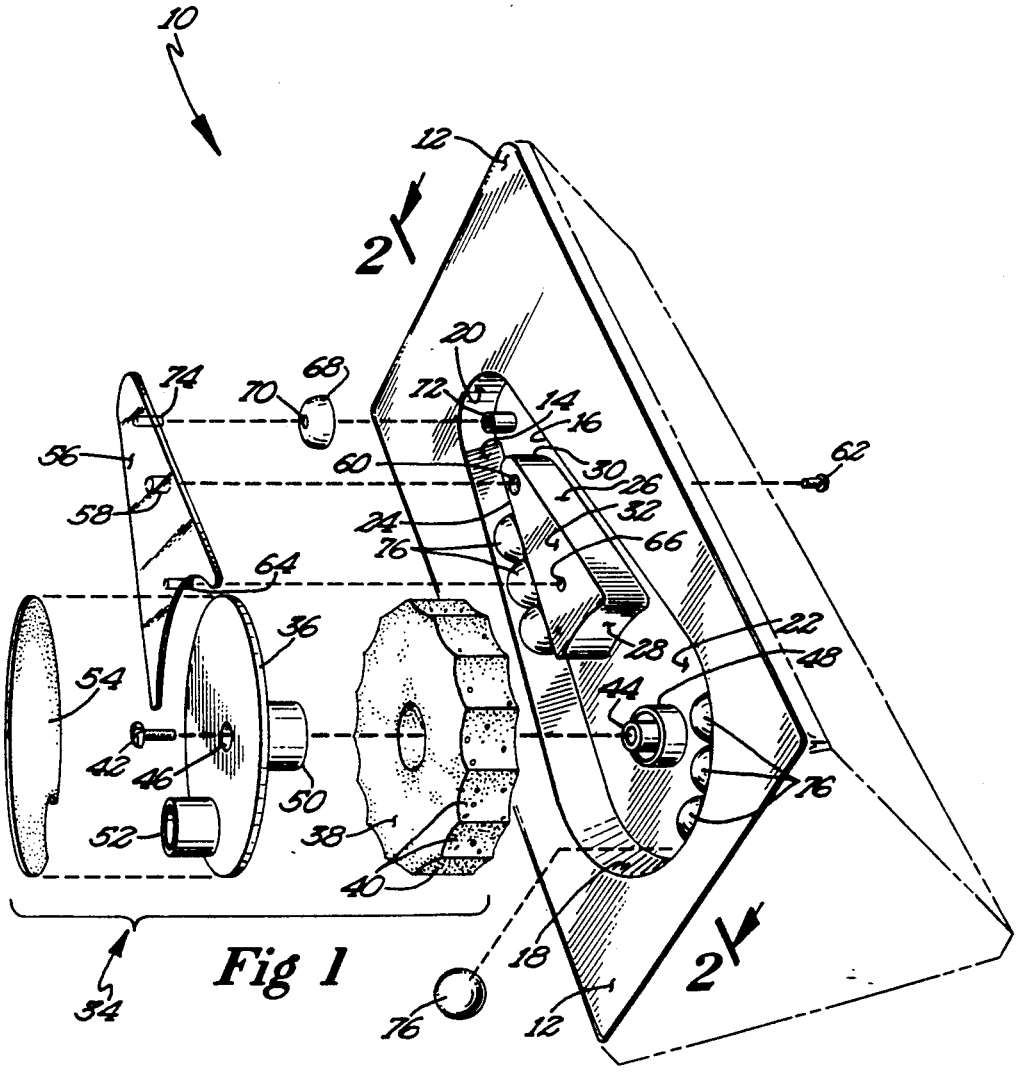
FIG. 1 shows an exploded perspective view of a toy according to the preferred teachings of the present invention.
Figure 2:
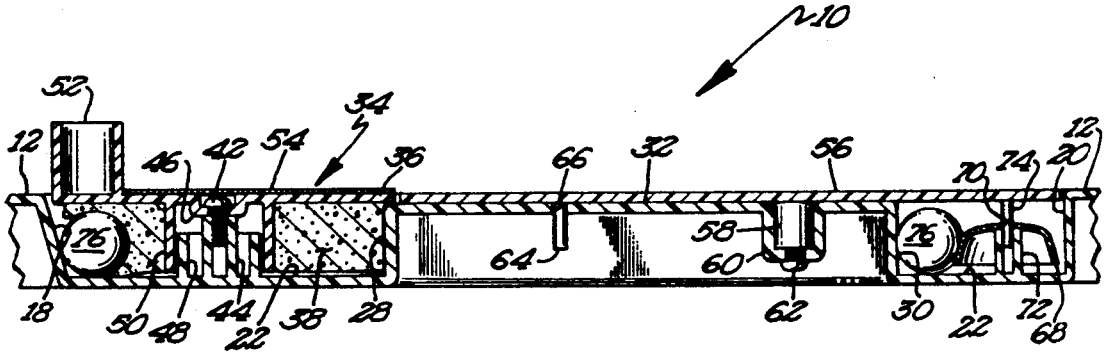
FIG. 2 shows a cross sectional view of the assembled toy of FIG. 1 according to section line 2—2 of FIG. 1.

All figures are drawn for ease of explanation of the basic teachings of the present invention only; the extensions of the Figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "inside", "outside", "end", "upper", "lower", "edge", "inner", "outer", and similar terms are used herein, it should be understood that these terms have reference only to the structure shown in the drawings as it would appear to a person viewing the drawings and are utilized only to facilitate describing the invention.

DESCRIPTION

A toy according to the preferred teachings of the present invention is shown in the drawings and generally designated 10. Toy 10 includes a generally planar panel 12. The upper edges of first and second walls 14 and 16 are integrally connected to panel 12, with walls 14 and 16 extending at an obtuse angle in the order of 110° from panel 12 and extending at an acute angle in the order of 66° relative to each other. The corresponding extremities of walls 14 and 16 are continuously connected together by arcuate, semicircular walls 18 and 20, with walls 14 and 16 extending generally tangentially from the extremities of walls 18 and 20. The upper edges of walls 18 and 20 are integrally connected to panel 12 and, in the most preferred form, wall 18 extends at an obtuse angle in the order of 110° from panel 12 and wall 20 extends at a perpendicular angle from panel 12. Further, the diameter of wall 18 is larger than the diameter of wall 20 and in the preferred form is a multiple and specifically three times larger.

The lower edges of walls 14, 16, 18, and 20 are integrally connected to a generally planar bottom 22 which is parallel to and spaced from panel 12. Third and fourth walls 24 and 26 upstand generally perpendicular to bottom 22, with walls 24 and 26 extending at an acute angle in the order of 66° relative to each other. Corresponding lines in walls 14 and 24 and in walls 16 and 26 parallel to and at corresponding spacing between panel 12 and bottom 22 are parallel to each other. The corresponding extremities of walls 24 and 26 are contiguously connected together by arcuate, semicircular walls 28 and 30. Walls 24 and 26 extend generally tangentially from the extremities of wall 30, with the diameter of wall 30 being a multiple of times smaller than the diameter of wall 20. Wall 28 has a diameter which is a multiple of the diameter of wall 30 and slightly less than the diameter of wall 18. Wall 28 is arranged concentrically to wall 18 but opposite to wall 18 such that a generally cylindrical void is formed and defined by walls 18 and 28. The upper edges of walls 24, 26, 28, and 30 are integrally connected to a generally planar top 32 which is parallel to and spaced from both panel 12 and bottom 22.

Toy 10 according to the preferred teachings of the present invention further includes a spinner 34 rotatably mounted in the cylindrical void formed by walls 18 and 28. Spinner 34 generally includes a circular disc 36 upon which is secured an annular member 38 formed of compressible material such as foam, cloth, or the like. The diameters of disc 36 and annular member 38 are generally equal, with the diameter of disc 36 being larger than the diameter of wall 28 but less than the diameter of wall 18 and the diameter of member 38 being generally equal to but slightly less than the diameter of wall 28. In the most preferred form, annular member 38 includes one or more scallops 40 of equal size extending around the entire cylindrical periphery of the outside edge of annular member 38.

In the preferred form, disc 36 and member 38 are rotatably mounted by a screw 42 extending through disc 36 and threadably received in a boss 44 upstanding from bottom 22, with boss 44 located at the diametric center of walls 18 and 28 such that disc 36 and member 38 are concentric to walls 18 and 28. In the most preferred form, disc 36 includes a countersunk depression 46 so that the head of screw 42 is positioned below the outer surface of disc 36. Additionally, a cylindrical collar 48 upstands from bottom 22 and a complementary cylindrical collar 50 upstands from the inner surface of disc 36, with the inside diameter of cylindrical collar 50 being of a size for rotatable receipt on the outside diameter of cylindrical collar 48. The outer surface of disc 36 is generally at the same level as the outer surface of panel 12. For purposes of rotating disc 36 and member 38, an annular crank handle 52 extends from disc 36 generally parallel to and spaced from screw 42 and collar 50 and on the opposite side of disc 36 therefrom, with handle 52 located adjacent the periphery of disc 36 in the most preferred form. Spinner 34 in the most preferred form includes a label 54 adhesively secured to the outer surface of disc 36 around crank handle 52. Label 54 prevents access to the head of screw 42 located in depression 46, covers the head of screw 42 for aesthetic reasons and generally prevents screw 42 from unthreading itself from boss 44 with rotation of spinner 34, and provides location for indicia such as trademarks or other label requirements.

Toy 10 according to the preferred teachings of the present invention further includes a cover 56 formed of transparent material. Cover 56 generally has a size and shape corresponding to walls 14, 16, 20, and 28. Cover 56 is secured to top 32 in the preferred form by a boss 58 upstanding from the inner surface of cover 56 and slideably received in a seat 60 formed in top 32. A screw 62 extends through seat 60 and is threadably received in boss 58. The edge of cover 56 corresponding to wall 28 is semicircular in shape having a diameter generally equal to disc 36 and is concentric thereto. Cover 56 further includes a locating stud 64 upstanding from the inner surface of cover 56 and slideably received in an aperture 66 formed in top 32.

Toy 10 according to the preferred teachings of the present invention further includes a bell 68. Bell 68 includes a top opening 70 and is mounted by a mounting boss 72 upstanding from bottom 22 and having a diameter larger than opening 70 and which slideably receives a stud 74 upstanding from the inner surface of cover 56 extending through opening 70, with stud 74 having a diameter less than opening 70 and in the most preferred form being hex shaped. Thus, bell 68 is loosely pinned in place by boss 72 and stud 74 to hold bell 68 while allowing vibration. In the preferred form, boss 72 is located at the diametric center of wall 20.

Toy 10 according to the preferred teaching of the present invention further includes a plurality of balls 76, with balls 76 having a diameter generally equal to but slightly smaller than the spacing between walls 14 and 24 and walls 16 and 26. The size of scallops 40 is complementary to balls 76. The heights of walls 14, 16, 18, 20, 24, 26, 28, and 30 are substantial with respect to balls 76 and in the preferred form are substantially equal to but slightly larger than the diameter of balls 76.

Toy 10 according to the preferred teachings of the present invention includes suitable provisions for holding panel 12, bottom 22, and top 32 in a non-horizontal position and with bosses 44 and 72 generally being at the same vertical height in the preferred form. In a most preferred form, panel 12 is one of three panels arranged in a triangular configuration, with the other two panels being shown in phantom in FIG. 1. It can then be appreciated that panel 12 will be held at a 60° angle to the horizontal when toy 10 rests on either of the other two panels, with wall 14 being vertically above wall 16 when resting on one of the other two panels and with wall 16 being vertically above wall 14 when toy 10 rests on the other of the other two panels.

Now that the basic construction of toy 10 according to the preferred teachings of the present invention has been explained, the operation of toy 10 can be set forth and appreciated. For purposes of explanation, it will be assumed that wall 14 is vertically above wall 16. However, operation is simply reversed if wall 16 is positioned vertically above wall 14. It can then be appreciated that a track for rolling receipt of balls 76 is formed and defined by first and second track walls. Specifically, the first track wall extends from the first extremity of wall 18 to the second extremity of wall 18 and includes walls 14, 20, and 16. The second track wall extends generally parallel to the first track wall and spaced therefrom a distance greater than the diameter of balls 76 and includes walls 24, 30, and 26. Cover 56 extends over and closes the track to prevent balls 76 from jumping or falling therefrom. The track has a first end adjacent the first extremity of wall 18 and a second end adjacent the second, opposite extremity of wall 18. Further, in the preferred form, the track includes a first downwardly inclined portion defined by walls 14 and 16 and a second downwardly inclined portion defined by walls 16 and 26. The first track portion includes the first end and a third end while the second track portion includes a fourth end and the second end. The third end of the first track portion is interconnected to the fourth end of the second track portion. The first end is vertically above the second end, the third end is vertically above the second end, and the fourth end is vertically above the second end. Thus, balls 76 are moveable under gravitational forces from the first end to the second end of the track. In the most preferred form, bell 68 is located at the interconnection of the first and second track portions of the track.

Balls 76 are moved between the first and second extremities of wall 18 by spinner 34. Specifically, the cylindrical periphery of the compressible material forming member 38 flexes, compresses or is otherwise moved relative to wall 18 for absorbing and capturing balls 76 located at the second end of the track between member 38 and wall 18, with the material forming member 38 being moveable relative to wall 18 by rotation of spinner 34 about the longitudinal axis of disc 36 and member 38 defined by screw 42 in the most preferred form. Specifically, balls 76 move to the second end of the track under the force of gravity and are caught up between member 38 and wall 18 as spinner 34 rotates. With rotation of spinner 34, balls 76 will be sandwiched between wall 18 and member 38, with balls 76 tending to compress member 38 due to its compressible nature. With continued rotation of spinner 34, balls 76 will move with member 38 and against wall 18. When balls 76 reach the first extremity of wall 18, balls 76 will be released from between member 38 and wall 18 into the first end of the track with a spring-like force due to the expansion of member 38 from its compressed condition. It should be noted that the angular relationship of walls 14, 16, and 18 to panel 12 and the cylindrical periphery of member 38 tend to bias the balls 76 to travel closely adjacent to disc 36 and help to allow capture of balls 76 by member 38 against wall 18. Scallops 40 in the cylindrical periphery of member 38 tend to prevent balls 76 from bunching up between wall 18 and member 38 but rather have a linear arrangement between wall 18 and member 38. The second track wall formed by walls 24, 26, and 30 extends from the first end of the track to the second end of the track, with wall 28 extending between the opposite extremities of the second track wall and the first and second ends of the track. It should be noted that the diametric relationship between member 38 and wall 28 also tends to prevent balls 76 from following member 38 past the first end of the track rather than entering the first end of the track.

In addition to the spring-like release force and due to the downward incline, balls 76 will also fall and/or roll under gravitational forces down the first track portion to the third end where they will strike and ring bell 68. Balls 76 will then free fall and/or roll under gravitational forces past bell 68 and enter the fourth end of the second track portion. It can then be appreciated that balls 76 hit and ring bell 68 at the pivot point of the direction change in the track between the first and second track portions. Due to the downward incline, balls 76 will free fall and/or roll under gravitational forces down the second track portion to the second end of the track. Balls 76 are moveable from the second end of the track by rotation of spinner 34 and the operation of toy 10 can be repeated.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Toy comprising, in combination: a ball having a diameter; at least a first wall having a first extremity and a second extremity, having a height which is substantial with respect to the ball, and having a generally semicircular shape between the first and second extremities; a track for rolling receipt of the ball having a first end adjacent the first extremity of the first wall and a second end adjacent the second extremity of the first wall; compressible material having a longitudinal axis and a cylindrical periphery of a diameter less than that of the semicircular shape of the first wall, with the compressible material being concentric to the first wall; a second, semicircular wall having a diameter generally equal to the diameter of the compressible material, with the semicircular wall extending between the first and second ends of the track and concentric to the compressible material and the first wall, with the first and second walls including lower edges; a bottom connected to the lower edges of the first and second walls; a disc, with the compressible material secured to the disc; a boss upstanding from the bottom along the longitudinal axis of the compressible material; and a screw extending through the disc and the compressible material and threadably received in the boss with the compressible material rotatable about the longitudinal axis for capturing the ball located at the second end of the track between the compressible material and the first wall for moving the ball between the first and second extremities of the first wall with the compressible material to the first end of the track, with the compressible material being in a compressed condition by the ball captured between the compressible material and the first wall and providing a spring-like force to the ball due to the expansion of the compressible material from its compressed condition at the first end of the track.

2. The toy of claim 1 wherein the track comprises, in combination: a first track wall extending from the first extremity to the second extremity of the first wall; and a second track wall extending generally parallel to the first track wall and spaced therefrom a distance greater than the diameter of the ball, with the second track wall extending from the first end to the second end of the track.

3. The toy of claim 2 further comprising, in combination: a cover extending over the track at least between the first and second track walls.

4. The toy of claim 3 wherein the track comprises, in combination: a first downwardly inclined portion including the first end and a third end; and a second downwardly inclined portion including a fourth end and the second end, with the third end of the first track portion being interconnected to the fourth end of the second track portion, with the first end being vertically above the third end, with the third end being vertically above the second end, with the fourth end being vertically above the second end, and with the ball movable under gravitational forces from the first end to the second end.

5. The toy of claim 4 further comprising, in combination: a bell located in the interconnection between the first and second inclined portions, with the ball engaging the bell as the ball moves from the first inclined portion to the second inclined portion.

6. The toy of claim 5 wherein the first and second track walls include lower edges, with the bottom connected to the lower edges of the first and second track walls; and wherein the bottom includes a bell boss upstanding from the bottom in the interconnection between the first and second inclined portions and having a diameter, with the bell having a top opening having a diameter less than the diameter of the bell boss; and a stud upstanding from the cover and through the top opening of the bell for loosely pinning the bell on the bell boss.

7. The toy of claim 6 wherein the stud is slideably received in the bell boss.

8. The toy of claim 7 wherein the second track wall includes an upper edge; wherein the toy further comprises, in combination: a top connected to the upper edge of the second track wall, with the cover extending over the top, with the cover being secured to the top.

9. The toy of claim 2 wherein the first track wall includes an upper edge; and wherein the toy further comprises, in combination: a panel connected to the upper edge of the first track wall.

10. The toy of claim 3 wherein the disc is generally circular in shape having a diameter generally equal to the first wall; and wherein the cover includes a semicircular edge of a diameter generally equal to the diameter of the disc, with the semicircular edge being concentric to the disc.

11. The toy of claim 1 wherein the compressible material is formed of foam.

12. The toy of claim 1 wherein the cylindrical periphery of the compressible material includes at least one scallop of a size complementary to the ball.

13. The toy of claim 1 wherein the compressible material is annular shaped; and wherein the toy further comprises, in combination: a first cylindrical collar upstanding from the bottom and having an outside diameter; and a second cylindrical collar upstanding from the disc having an inside diameter for rotatable receipt on the outside diameter of the first cylindrical collar.

14. The toy of claim 1 further comprising, in combination: a bell located in the track between the first and second ends of the track, with the ball rolling from the first end to the second end of the track and engaging the bell as the ball moves from the first end to the second end of the track.

15. The toy of claim 1 wherein the track comprises, in combination: a first downwardly inclined portion including the first end and a third end; and a second downwardly inclined portion including a fourth end and the second end, with the third end of the first track portion being interconnected to the fourth end of the second track portion, with the first end being vertically above the third end, with the third end being vertically above the second end, with the fourth end being vertically above the second end, and with the ball movable under gravitational forces from the first end to the second end.

16. The toy of claim 1 wherein the compressible material is formed of foam.

* * * * *

UNITED STATES PATENT AND TRADEMARK OFFICE

CERTIFICATE OF CORRECTION

PATENT NO. : 5,188,556

DATED : February 23, 1993

INVENTOR(S) : Mark Hartellius et al.

It is certified that error appears in the above-identified patent and that said Letters Patent is hereby corrected as shown below:

On the Title page, item [57]

In the ABSTRACT, line 4, cancel "semiconductor" and substitute therefor --semicircular--.

Column 8, line 18, cancel "1" and substitute therefor --12--.

Signed and Sealed this

Thirtieth Day of November, 1993

Bruce Lehman

*Attest:*

BRUCE LEHMAN

*Attesting Officer*

*Commissioner of Patents and Trademarks*